US007918945B2

(12) United States Patent
Izawa et al.

(10) Patent No.: US 7,918,945 B2
(45) Date of Patent: Apr. 5, 2011

(54) METHOD FOR MANUFACTURING SURFACE TREATED STEEL MATERIAL USING A CHEMICAL CONVERSION TREATMENT LIQUID

(75) Inventors: Masaru Izawa, Kobe (JP); Kunio Goto, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 733 days.

(21) Appl. No.: 10/771,294

(22) Filed: Feb. 5, 2004

(65) Prior Publication Data

US 2004/0154700 A1 Aug. 12, 2004

Related U.S. Application Data

(62) Division of application No. 10/277,964, filed on Oct. 23, 2002, now Pat. No. 6,756,092.

(30) Foreign Application Priority Data

Feb. 26, 2001 (JP) ..... 2001-050740
Dec. 3, 2001 (JP) ..... 2001-368776

(51) Int. Cl.
*C23C 22/08* (2006.01)
*C23C 22/00* (2006.01)

(52) U.S. Cl. ..... 148/262; 148/253; 106/14.05; 106/14.11; 106/14.12; 106/14.14

(58) Field of Classification Search ..... 148/253, 148/262; 106/14.05, 14.11, 14.12, 14.14
See application file for complete search history.

(56) References Cited

U.S. PATENT DOCUMENTS

| | | | | |
|---|---|---|---|---|
| 3,798,074 | A | 3/1974 | Esler et al. | |
| 4,474,651 | A * | 10/1984 | Yauchi et al. | 285/329 |
| 4,486,241 | A * | 12/1984 | Donofrio | 148/262 |
| 4,529,451 | A * | 7/1985 | Otrhalek et al. | 148/241 |
| 4,770,943 | A | 9/1988 | Hakamatsuka et al. | |
| 4,881,975 | A * | 11/1989 | Collier et al. | 106/14.05 |
| 4,927,472 | A | 5/1990 | Matsushima et al. | |
| 5,238,506 | A | 8/1993 | Cape et al. | |
| 5,728,235 | A * | 3/1998 | Boulos et al. | 148/257 |
| 5,932,292 | A | 8/1999 | Nagashima et al. | |
| 6,231,688 | B1 | 5/2001 | Ishii et al. | |
| 2002/0011281 | A1 * | 1/2002 | Geke et al. | 148/260 |

FOREIGN PATENT DOCUMENTS

EP 0 393 802 10/1990

(Continued)

OTHER PUBLICATIONS

"Metals Handbook: Desk Edition", 2nd ed., ASM International, 1998, pp. 1157-1158.*

*Primary Examiner* — Roy King
*Assistant Examiner* — Lois Zheng
(74) *Attorney, Agent, or Firm* — Clark & Brody

(57) ABSTRACT

A method of manufacturing a surface treated oil well pipe comprising performing chemical conversion treatment on an oil well pipe having a steel composition containing 0.5-13% Cr using a chemical conversion treatment liquid containing zinc and phosphoric acid or manganese and phosphoric acid and further containing potassium tetraborate to form a chemical conversion film of a zinc-phosphate type or a manganese phosphate type, wherein the chemical conversion treatment is carried out in the absence of fluoride ions.

6 Claims, 1 Drawing Sheet

FOREIGN PATENT DOCUMENTS

| | | | | |
|---|---|---|---|---|
| EP | 786616 | A1 | | 7/1997 |
| FR | 1 017 714 | | | 12/1952 |
| JP | 57-082478 | | | 5/1982 |
| JP | 64000260 | A | | 1/1989 |
| JP | 01-219173 | | | 9/1989 |
| JP | 04-297585 | | | 10/1992 |
| JP | 08-020876 | | | 1/1996 |
| JP | 08-246161 | | | 9/1996 |
| JP | 09/263958 | | | 10/1997 |
| JP | 2001--335956 | | * | 12/2001 |
| WO | 9610710 | A1 | | 4/1996 |

* cited by examiner

METHOD FOR MANUFACTURING SURFACE TREATED STEEL MATERIAL USING A CHEMICAL CONVERSION TREATMENT LIQUID

This application is a divisional of application Ser. No. 10/277,964, filed on Oct. 23, 2002, now U.S. Pat. No. 6,756,092.

TECHNICAL FIELD

This invention relates to a chemical conversion treatment liquid for forming a chemical conversion film on the surface of a steel material such as a Cr-containing steel and to a surface treatment method employing the liquid.

The present invention also relates to a surface treated steel material which is manufactured using such a surface treatment method and particularly to a surface treated steel material having excellent seizing resistance.

BACKGROUND ART

Chemical conversion treatment is a type of treatment in which the surface of a steel material and a corrosive solution are chemically reacted with each other to form a film of a corrosion product having good adhesion to the surface of the steel material. Chemical conversion treatment is frequently referred to as phosphate treatment, chromate treatment, oxalate treatment, etc. depending upon the type of corrosive solution which is employed.

However, a chemical conversion film cannot be formed by such conventional chemical conversion treatment on a steel such as a high-Cr steel.

As disclosed in Japanese Published Unexamined Patent Application 57-82478, for example, a method is known in which chemical conversion treatment is performed on the surface of a steel material using a chemical conversion treatment liquid based on an alkali metal phosphate and containing a titanium compound and a chlorate salt, after which further chemical conversion treatment is performed using a chemical conversion treatment liquid containing a zinc phosphate. However, this method has the disadvantage that treatment must be performed two times. Moreover, this method cannot form a sound chemical conversion film of a phosphate on a high-Cr steel such as a 13% Cr steel.

Japanese Published Unexamined Patent Application 5-40034 discloses a method of surface treatment using a chemical conversion treatment liquid containing manganese and phosphoric acid to which fluoride ions are added. However, even with this method, it is not possible to form a chemical conversion film on a Cr-containing steel.

Oil well steel pipes are connected to each other through couplings. For this purpose, male threads formed on the ends of oil well steel pipes are mated with female threads formed on the inner surface of couplings, and the threads are tightened to form a gas- and liquid-tight joint connecting the pipes. At the time of tightening, a large torque is applied to the threads, so it becomes easy for defects such as galling to occur on the thread surface, which reduces the number of times which the oil well steel pipes can be repeatedly connected to each other. In addition, if corrosion occurs on the thread surface, it becomes difficult to guarantee an adequate gas tightness and liquid tightness.

Accordingly, in the past, the thread surface of a threaded joint for oil well steel pipes made of a Cr-containing steel was plated with a soft metal such as Cu in order to prevent galling.

However, due to the man hours required for plating, the plating method is not satisfactory, and there is room for improvements.

DISCLOSURE OF INVENTION

Thus, there has been a demand for a technique which can stably form a sound chemical conversion film such as a zinc phosphate film or a manganese phosphate film on the surface of a Cr-containing steel.

An object of this invention is to provide a chemical conversion treatment liquid which can stably form a chemical conversion film of a phosphate even on the surface of a Cr-containing steel such as one containing 0.5-13% Cr.

Another object of this invention is to provide a method of manufacturing a surface treated steel material in which the surface treatment is performed in such a manner that a chemical conversion film of a phosphate can be stably formed even on the surface of the above-described Cr-containing steel.

Yet another object of this invention is to provide a surface treated steel material having such a chemical conversion film of a phosphate formed thereon.

The present inventors found that the addition of a potassium compound to a phosphate-type chemical conversion treatment liquid results in a significant improvement in the film-forming ability and makes it possible to stably form a phosphate-type chemical conversion film even on a Cr-containing steel, on which it has been difficult to form a chemical conversion film.

Based on these findings, the present inventors continued research and development and further found that such effect of a potassium compound and particularly of potassium tetraborate is generally seen in chemical conversion films formed by chromate treatment, oxalate treatment, and the like, and completed the present invention.

In a broad sense, the present invention is a surface treated steel material comprising a steel material and a chemical conversion film formed on at least a portion of the surface of the steel material, the chemical conversion film containing potassium in an amount of 0.1-1000 $mg/m^2$ and having a thickness of 5-50 micrometers and preferably 5-35 micrometers.

In a preferred embodiment of the invention, the chemical conversion film is a phosphate-type chemical conversion film, such as a zinc phosphate-type chemical conversion film, or a manganese phosphate-type chemical conversion film. In the case of oil well steel pipes, it is preferred that a manganese phosphate-type chemical conversion film is formed on a joint portion of couplings and a zinc phosphate-type chemical conversion film is formed on a joint portion of oil well steel pipes.

According to another aspect, the present invention is a method of manufacturing a surface treated steel material wherein chemical conversion treatment is carried out on the surface of a steel material using a chemical conversion treatment liquid containing zinc and phosphoric acid or manganese and phosphoric acid, and further containing potassium.

The chemical conversion treatment liquid preferably has a molar concentration of potassium-containing ions of at least $6\times10^{-4}$% and at most $7\times10^{-1}$%.

The chemical conversion treatment may be carried out by immersing the steel material in the chemical conversion treatment liquid for at least five minutes at a temperature of 60-100° C. and preferably of 70-100° C.

Alternatively, the chemical conversion treatment may be carried out by supplying the chemical conversion treatment liquid to the steel material for at least five minutes at a temperature of 60-100° C. and preferably 70-100° C.

According to yet another aspect, the present invention is a chemical conversion treatment liquid for a steel material containing zinc and phosphoric acid or manganese and phosphoric acid and further containing potassium.

In a preferred embodiment, the molar concentration of potassium-containing ions in the chemical conversion treatment liquid is preferably at least $6\times10^{-4}$% and at most $7\times10^{-1}$%.

When the chemical conversion treatment liquid of this invention contains manganese and phosphoric acid and further contains potassium, the total acid number is preferably at least 30 and less than 55, and the ratio of the total acid number to the free acid number is preferably 3-15.

BEST MODE FOR CARRYING OUT THE INVENTION

Figure 1:
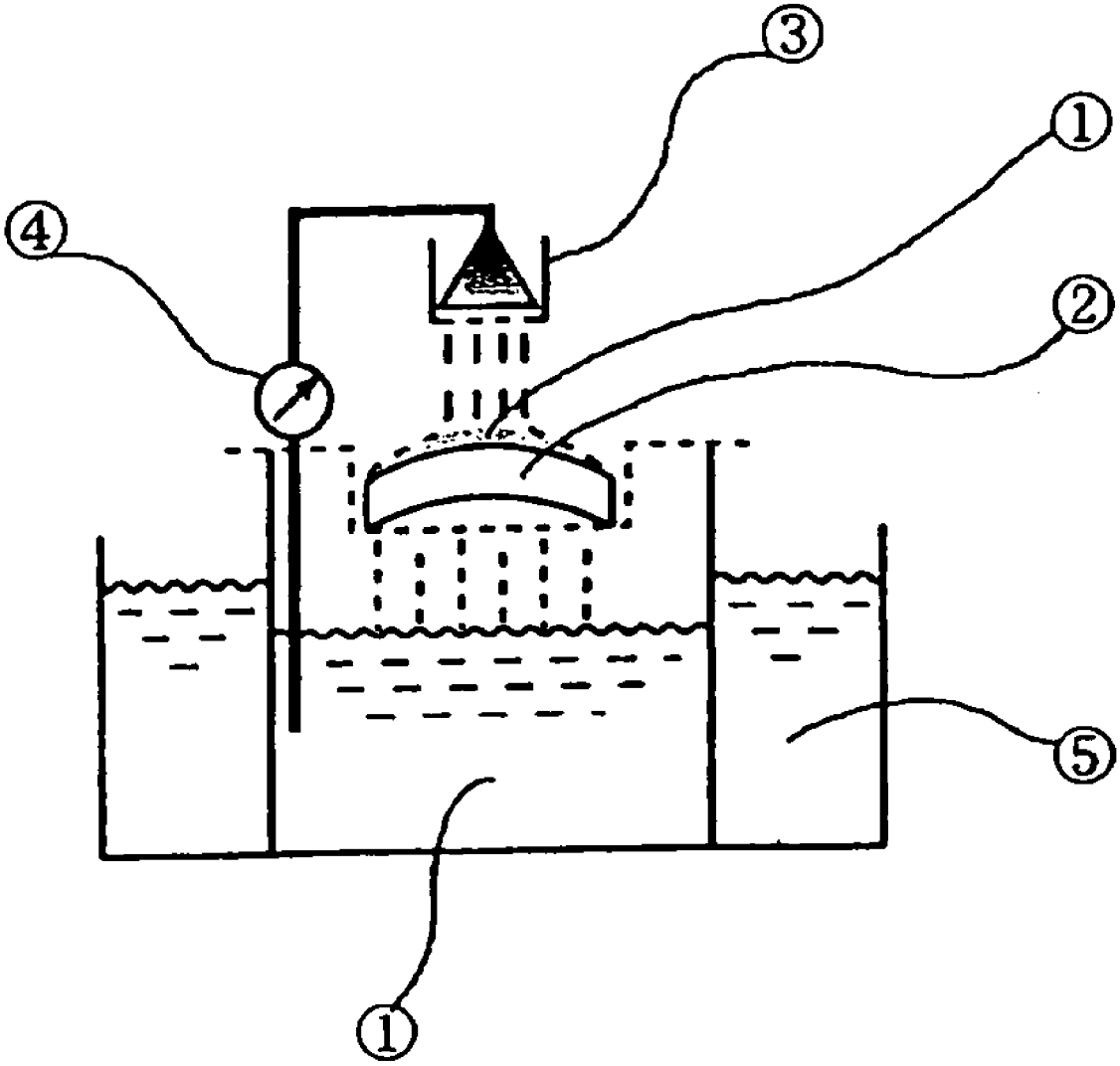
FIG. 1 is a schematic view of a setup for a dripping test method used in an example of the present invention.

The present invention will now be described in more detail. In this specification, unless otherwise specified, "%" means "mass %"

According to the present invention, after the surface of a steel material to be treated has been degreased and rinsed with water, chemical conversion treatment such as phosphate-type, chromate-type, or oxalate-type treatment is performed on the steel material. Chemical conversion treatment using a chemical conversion treatment liquid containing zinc and phosphoric acid or manganese and phosphoric acid is particularly preferred. Such a chemical conversion treatment liquid is referred to as a zinc-phosphoric acid type or a manganese-phosphoric acid type chemical conversion treatment liquid. The chemical conversion treatment method itself is known. Therefore, a description of the chemical conversion treatment method itself will be omitted.

There are no particular restrictions on the chemical composition of a steel material used in the present invention, but the present invention is particularly advantageous when carried out on a Cr-containing steel containing 0.5-13 mass % (indicated below simply by %) of Cr, on which it is difficult to perform chemical conversion treatment by conventional methods.

There are also no limitations on the form of the steel material. For example, it can be a seamless pipe used as an oil well steel pipe or a coupling therefor and particularly a threaded joint portion of the pipe or coupling. Alternatively, it can be in the form of another type of pipe, a rod, a plate or sheet, or the like. The present invention is particularly advantageous from the standpoint of economy when applied to a threaded joint for a seamless steel pipe such as an oil well steel pipe made of a Cr-containing steel.

The surface roughness Rmax of the portion of the surface of the steel material which is to be treated is preferably adjusted to be 0.1-60 micrometers.

The term "chemical conversion film" used herein refers to a film which is formed when a product of a chemical reaction between a solution and the surface of steel material adheres to the steel surface in the form of a film. Among the various types of chemical conversion film are phosphate types, chromate types, oxalate types, etc., depending upon the type of solution used to form the film. In the present invention, there are no particular restrictions on the type of the chemical conversion film as long as it contains potassium. However, when the present invention is applied to a joint for a seamless steel pipe such as an oil well steel pipe, the film is preferably a phosphate-type chemical conversion film. This is because phosphate types and particularly phosphoric acid-manganese types or phosphoric acid-zinc types of chemical conversion film have excellent adhesion to a steel surface and also have excellent rust preventing properties and resistance to galling. More preferably the chemical conversion film is a phosphoric acid-manganese type chemical conversion film.

A "chemical conversion treatment liquid" refers to a treatment liquid used to form such a chemical conversion film. Chemical conversion treatment liquids also include phosphate types, chromate types, oxalate types, etc.

In the present invention, a chemical conversion treatment liquid contains a potassium compound for promoting the formation of a chemical conversion film, increasing the uniformity of the chemical conversion film, and preventing lack of hiding (exposure of the metallic substrate beneath the film). However, if F ions and Al ions are present together in the chemical conversion treatment liquid, due to the action of Fe ions and Zn ions which are present at the same time, a sludge of $K_2Al(Fe,Zn)F_6$ may form and precipitate, and the addition of a potassium compound to the chemical conversion treatment liquid cannot produce the desired effects. Accordingly, chemical conversion treatment is preferably carried out in the absence of fluoride ions.

Examples of potassium compounds which can be used in the present invention include borates (such as potassium tetraborate), hydroxides (such as potassium hydroxide), fluorides (such as potassium fluoride), nitrates (such as potassium nitrate), chlorides (such as potassium chloride), sulfates (such as potassium sulfate), and the like. A single one of these potassium compounds may be used, or two or more may be used in combination. Preferably the potassium compound is a borate, and more preferably it is potassium tetraborate. The potassium compound is used by adding it to a chemical conversion treatment liquid containing zinc or manganese.

The mechanism of the effect which potassium has on the formation of a chemical conversion film is thought to be as follows in the case of a phosphate-type chemical conversion treatment liquid.

The addition of a potassium compound to a chemical conversion treatment liquid destroys the equilibrium condition of zinc or manganese with phosphoric acid in the liquid, soluble potassium phosphate is formed, and it dissolves in the liquid. At the same time, the excess zinc or manganese forms a floating insoluble gel having feather-like projections. It is thought that this floating material is rapidly adsorbed by the surface of the steel material and acts as nuclei for promoting the formation of a film of a phosphate on the steel surface, and that it forms a sound phosphate film having a minimized amount of lack of hiding (exposure of the metallic substrate).

Although the cause is not clear, with a chemical conversion treatment liquid to which a sodium compound ($Na_2B_40_7.10H_20$) is added instead of a potassium compound, a chemical conversion film with a thickness of 10 micrometers can be obtained, but there is a large amount of lack of hiding, and the film cannot be said to be practical. Accordingly, the above-described excellent effect is thought to be specific with potassium compounds.

A potassium compound can be added to a chemical conversion treatment liquid in the form of a powder or in the form of an aqueous solution. It can be added when initially preparing the chemical conversion treatment liquid, or it can be added immediately before chemical conversion treatment or during chemical conversion treatment.

In a preferred embodiment of the present invention, the chemical conversion treatment liquid is a manganese phosphate-type chemical conversion treatment liquid containing a potassium compound, in which the liquid is adjusted to have a total acid number of at least 30 and less than 55 and to have a ratio of total acid number to free acid number of 3-15.

The "total acid number" of a chemical conversion treatment liquid is the titration value (ml) when a 10 ml sample of the liquid is subjected to neutralization titration with a sodium hydroxide solution having a concentration of 0.1 ml/l using phenolphthalein as an indicator. The "free acid number" of a chemical conversion treatment liquid is the titration value (ml) when neutralization titration is performed on a 10 ml sample of the liquid using bromophenol as an indicator. The "ratio of total acid number to free acid number" is the total acid number divided by the free acid number and is also referred to as the acid ratio.

If the total acid number of a chemical conversion treatment liquid containing potassium is less than 30, the manganese phosphate-type film which is formed on the steel material being treated is not sufficiently uniform, and lack of hiding (exposure of the metallic substrate) may occur. Furthermore, even if a uniform chemical conversion film is formed, the treatment time required for film formation is extremely long, so chemical conversion treatment becomes uneconomical. If the total acid number is 55 or greater, the manganese phosphate crystals formed on the surface of the steel material being treated become extremely coarse, so lack of hiding may also occur, and the adhesion of the chemical conversion film to the steel material being treated deteriorates, leading to a deterioration in the resistance of the steel material to galling. Preferably, the total acid number is 35-53.

The ratio of the total acid number to the free acid number is 3-15 and preferably 6-11 for the same reasons that the total acid number is limited to the above-described range.

The concentration of potassium compounds in the chemical conversion treatment liquid in mass % is preferably 0.01-10%. If the concentration of potassium compounds is less than 0.01%, the film thickness is insufficient. On the other hand, if the concentration of potassium compounds exceeds 10%, the effect of the potassium compounds on film formation saturates. From the standpoint of obtaining a uniform film thickness, the concentration of the potassium compound is more preferably 0.1-10% and still more preferably 0.1-1%. This concentration corresponds to a molar concentration of potassium-containing ions of at least $6\times10^{-4}$% and at most $7\times10^{-1}$%. A still more potassium-containing ions is at least $6\times10^{-3}$% and at most $7\times10^{-1}$%. A still more preferred range is at least $6\times10^{-3}$% and at most $7\times10^{-2}$%.

When the chemical conversion treatment liquid and the surface of the steel material are reacted, whether the liquid is applied by immersion, spraying, or other method, the temperature of the chemical conversion treatment liquid is adjusted to 60-100° C. and preferably to 70-100° C.

For example, the temperature of a manganese phosphate-type chemical conversion treatment liquid is preferably 60-100° C. The temperature of a phosphoric acid-zinc type chemical conversion treatment liquid is 70-100° C. and preferably 70-90° C. If the temperature is less than 60° C. or 70° C., respectively, the speed of a film-forming reaction may extremely decrease. The temperature of a manganese phosphate-type chemical conversion treatment liquid is desirably at least 85° C. and preferably 95-98° C. This is because if the chemical conversion treatment liquid boils, the evaporation of water becomes violent, and the concentration of the chemical conversion treatment liquid ends up being too high. Particularly in the case of a zinc phosphate-type chemical conversion treatment liquid, if the temperature exceeds 90° C., etching of the substrate iron surface becomes severe during the initial reaction stage, a large amount of hydrogen gas is formed, and gas can accumulate in the bottom of a steel pipe such as a joint for an oil well steel pipe, so film formation can be obstructed, and there is a case that a uniform and sound film cannot be formed. At such a temperature, the immersion time of the steel material being treated or the length of contact between the steel material and the chemical conversion treatment liquid in the case of spraying is at least 5 minutes.

There are no particular restrictions on a method of forming a chemical conversion film on a steel surface using a treatment liquid containing potassium. After subjected to pretreatment such as degreasing and rinsing with water, the steel material can be immersed in the chemical conversion treatment liquid, or the treatment liquid can be supplied to the surface of the steel material by spraying or other method.

In general, in manganese phosphate-type chemical conversion treatment, it was thought that after the steel material to be treated is subjected to pretreatment such as degreasing, rinsing with water, pickling, and rinsing with water, it must be further subjected to surface adjustment treatment with an aqueous solution of a mixture of manganese phosphate and sodium pyrophosphate, but in the present invention, prior to performing manganese phosphate-type chemical conversion treatment, such surface adjustment treatment is not necessary.

A chemical conversion film which is formed using the chemical conversion treatment liquid according to the present invention can uniformly cover the steel surface. The potassium content of such a chemical conversion film is 0.1-1000 mg/m$^2$, and in this case, by making the thickness 5-50 micrometers, preferably 5-35 micrometers, the effect thereof can be adequately exhibited. Furthermore, the crystals are fine and dense, so they have an excellent ability to retain a lubricant such as grease or a solid lubricant between crystals, good lubricating properties are exhibited, and when it is provided in a joint for an oil well steel pipe and particularly on threads, it exhibits excellent properties.

The uniformity of the chemical conversion film increases and exposure of the metallic substrate is reduced if the amount of potassium in the film is at least 0.1 mg/m$^2$. There are no further improvements in the properties of the film when the amount of potassium in the film exceeds 1000 mg/m$^2$, so in light of economy, the amount is preferably at most 1000 mg/m$^2$.

If the thickness of the chemical conversion film is less than 5 micrometers, the film cannot exhibit adequate properties such as corrosion resistance. On the other hand, if the film thickness exceeds 50 micrometers, the amount of phosphoric acid and zinc or manganese consumed in the chemical conversion treatment liquid naturally becomes large and the liquid is rapidly used up. In light of economy, the film thickness is preferably at most 35 micrometers.

The content of potassium compounds in the chemical conversion treatment liquid and the content of potassium compounds in the chemical conversion film are not always the same since the latter varies depending upon the type of steel material and other chemical conversion treatment conditions. In particular, in the case of a Cr-containing steel, with a low temperature of 20-30° C. or a chemical conversion time of less than 5 minutes, the resulting chemical conversion film does not contain an adequate amount of potassium and it has an increased lack of hiding with an inferior resistance to galling.

Next, the effects of the present invention will be described more specifically in connection with working examples.

EXAMPLES

Example 1

In this example, phosphate chemical conversion treatment was carried out using three Cr-containing steels (C: 0.25%) with a Cr content of 1%, 3%, or 13%.

Each of the Cr-containing steels was melted in a vacuum melting furnace and then cast into a 25-kg rectangular ingot, which was hot rolled to a thickness of 8 mm and then machined to form test pieces having a thickness of 5 mm, a width of 25 mm, a length of 30 mm, and a surface roughness Rmax of 5 micrometers.

Potassium tetraborate was used as a potassium compound, and a commercially available zinc phosphate chemical conversion treatment liquid was used as a chemical conversion treatment liquid.

A chemical conversion treatment liquid was prepared by adding potassium tetraborate to the zinc phosphate liquid to give a concentration of 0-10% and it was placed at a temperature of 75° C. in a 500 ml container. Test pieces which had been subjected to pretreatment such as degreasing and rinsing with water were immersed in the liquid for 5 minutes and then pulled out and rinsed with water and dried.

The thickness of the film which was formed on the surface of the test pieces was measured with an electromagnetic film thickness meter. The uniformity of the film was evaluated with a scanning electron microscope (SEM) and with an image analyzer. The potassium content of the film was determined by immersing the chemically treated test pieces in an aqueous 5% chromic acid solution at 75° C. to dissolve just the film followed by atomic absorption analysis of the resulting solution to determine the amount of potassium.

The test results are shown in Table 1.

TABLE 1

| Potassium tetraborate | | | Film | | | | |
|---|---|---|---|---|---|---|---|
| | | | Thickness | | Potassium | Film | |
| Mass % | Mole % | Test No. | (μm) | Eval[1] | Content (mg/m$^2$) | Uniformity | O.E.[2] |
| 1 Cr Steel | | | | | | | |
| 0 | 0 | 1 | 6 | ○ | 0 | Δ | X |
| 0.001 | $6.54 \times 10^{-5}$ | 2 | 8 | ○ | 0.08 | Δ | X |
| 0.005 | $3.27 \times 10^{-4}$ | 3 | 12 | ○ | 0.08 | Δ | X |
| 0.01 | $6.54 \times 10^{-4}$ | 4 | 15 | ○ | 2 | ○ | ○ |
| 0.05 | $3.27 \times 10^{-3}$ | 5 | 18 | ○ | 6 | ○ | ○ |
| 0.1 | $6.54 \times 10^{-3}$ | 6 | 23 | ○ | 10 | ○ | ○ |
| 0.25 | $1.64 \times 10^{-2}$ | 7 | 26 | ○ | 28 | ○ | ○ |
| 0.5 | $3.27 \times 10^{-2}$ | 8 | 30 | ○ | 53 | ○ | ○ |
| 1 | $6.54 \times 10^{-2}$ | 9 | 34 | ○ | 98 | ○ | ○ |
| 2.5 | $1.64 \times 10^{-1}$ | 10 | 35 | ○ | 260 | ○ | ○ |
| 5 | $3.27 \times 10^{-1}$ | 11 | 35 | ○ | 600 | ○ | ○ |
| 10 | $6.54 \times 10^{-1}$ | 12 | 35 | ○ | 1040 | ○ | ○ |
| 3 Cr Steel | | | | | | | |
| 0 | 0 | 13 | 2 | X | 0 | X | X |
| 0.001 | $6.54 \times 10^{-5}$ | 14 | 4 | X | 0.06 | Δ | X |
| 0.005 | $3.27 \times 10^{-4}$ | 15 | 10 | ○ | 0.08 | Δ | X |
| 0.01 | $6.54 \times 10^{-4}$ | 16 | 14 | ○ | 2 | ○ | ○ |
| 0.05 | $3.27 \times 10^{-3}$ | 17 | 16 | ○ | 6 | ○ | ○ |
| 0.1 | $6.54 \times 10^{-3}$ | 18 | 20 | ○ | 9 | ○ | ○ |
| 0.25 | $1.64 \times 10^{-2}$ | 19 | 22 | ○ | 25 | ○ | ○ |
| 0.5 | $3.27 \times 10^{-2}$ | 20 | 28 | ○ | 48 | ○ | ○ |
| 1 | $6.54 \times 10^{-2}$ | 21 | 30 | ○ | 93 | ○ | ○ |
| 2.5 | $1.64 \times 10^{-1}$ | 22 | 34 | ○ | 260 | ○ | ○ |
| 5 | $3.27 \times 10^{-1}$ | 23 | 35 | ○ | 586 | ○ | ○ |
| 10 | $6.54 \times 10^{-1}$ | 24 | 35 | ○ | 910 | ○ | ○ |
| 13 Cr Steel | | | | | | | |
| 0 | 0 | 25 | 0 | X | 0 | X | X |
| 0.001 | $6.54 \times 10^{-5}$ | 26 | 3 | X | 0.01 | X | X |
| 0.005 | $3.27 \times 10^{-4}$ | 27 | 8 | ○ | 0.08 | X | X |
| 0.01 | $6.54 \times 10^{-4}$ | 28 | 13 | ○ | 1 | ○ | ○ |
| 0.05 | $3.27 \times 10^{-3}$ | 29 | 15 | ○ | 5 | ○ | ○ |
| 0.1 | $6.54 \times 10^{-3}$ | 30 | 18 | ○ | 9 | ○ | ○ |
| 0.25 | $1.64 \times 10^{-2}$ | 31 | 21 | ○ | 23 | ○ | ○ |
| 0.5 | $3.27 \times 10^{-2}$ | 32 | 26 | ○ | 48 | ○ | ○ |
| 1 | $6.54 \times 10^{-2}$ | 33 | 26 | ○ | 86 | ○ | ○ |
| 2.5 | $1.64 \times 10^{-1}$ | 34 | 30 | ○ | 215 | ○ | ○ |
| 5 | $3.27 \times 10^{-1}$ | 35 | 33 | ○ | 572 | ○ | ○ |
| 10 | $6.54 \times 10^{-1}$ | 36 | 35 | ○ | 915 | ○ | ○ |

[1]Evaluation;
[2]Overall Evaluation

In the table, the film thickness was evaluated as follows: X (unacceptable) indicates a film thickness of less than 5 micrometers and ○ (good) indicates a film thickness of at least 5 micrometers. The uniformity of the film was evaluated by the test result of area ratio (%) of unhidden surface (exposed metallic surface) observed in the film formed on the test pieces. ○ (good) indicates an area ratio of at most 5%, Δ (usual) indicates an area ratio of greater than 5% and at most 20%, and X (unacceptable) indicates an area ratio exceeding 20%. For the overall evaluation, ○ (acceptable) indicates that the test results were ○ for both the film thickness and the uniformity of the film, and X (unacceptable) indicates that the test results were Δ or X for one or both of the film thickness and the film uniformity.

Example 2

The test materials used in this example were steels having the following steel compositions:

(1) Carbon steel-C: 0.25%, (2) Cr—Mo steel-C: 0.25%, Cr: 1.0%, Mo: 0.5%, (3) Cr steel-C: 0.25%, Cr: 3%, 5%, 13%, or 22%, Example 1 was repeated except that a commercially available manganese phosphate chemical conversion treatment liquid was used as a chemical conversion treatment liquid.

Potassium tetraborate was added to the manganese phosphate chemical conversion treatment liquid to give a concentration of 0-10%, and the resulting chemical conversion treatment liquid was placed at a temperature of 85° C. in a 500 ml container. Test pieces which had been subjected to pretreatment such as degreasing and rinsing were immersed in the chemical conversion treatment liquid for ten minutes and then were pulled out and rinsed with water and dried.

The resulting chemical conversion film was evaluated in the same manner as in Example 1.

The 22 Cr steel was a comparative example, while the other steels (carbon steel, 1 Cr-0.5 Mo steel. 3 Cr steel, 5 Cr steel and 13 Cr steel) were examples of steels for use in a steel material according to the present invention.

The test results are shown in Table 2 and Table 3.

TABLE 2

| Potassium tetraborate | | | Film | | | | |
|---|---|---|---|---|---|---|---|
| | | | Thickness | | Potassium | Film | |
| Mass % | Mole % | Test No. | (μm) | Eval[1] | Content (mg/m$^2$) | Uniformity | O.E.[2] |
| Carbon steel | | | | | | | |
| 0 | 0 | 1 | 10 | ○ | 0 | ○ | ○ |
| 0.001 | $6.54 \times 10^{-5}$ | 2 | 15 | ○ | 0.08 | ○ | ○ |
| 0.005 | $3.27 \times 10^{-4}$ | 3 | 18 | ○ | 0.3 | ○ | ○ |
| 0.01 | $6.54 \times 10^{-4}$ | 4 | 22 | ○ | 4 | ○ | ○ |
| 0.05 | $3.27 \times 10^{-3}$ | 5 | 22 | ○ | 8 | ○ | ○ |
| 0.1 | $6.54 \times 10^{-3}$ | 6 | 26 | ○ | 10 | ○ | ○ |
| 0.25 | $1.64 \times 10^{-2}$ | 7 | 30 | ○ | 30 | ○ | ○ |
| 0.5 | $3.27 \times 10^{-2}$ | 8 | 33 | ○ | 63 | ○ | ○ |
| 1 | $6.54 \times 10^{-2}$ | 9 | 38 | ○ | 108 | ○ | ○ |
| 2.5 | $1.64 \times 10^{-1}$ | 10 | 43 | ○ | 256 | ○ | ○ |
| 5 | $3.27 \times 10^{-1}$ | 11 | 48 | ○ | 537 | ○ | ○ |
| 10 | $6.54 \times 10^{-1}$ | 12 | 53 | ○ | 1128 | ○ | ○ |
| 1 Cr-0.5 Mo Steel | | | | | | | |
| 0 | 0 | 13 | 4 | X | 0 | Δ | X |
| 0.001 | $6.54 \times 10^{-5}$ | 14 | 10 | ○ | 0.08 | Δ | X |
| 0.005 | $3.27 \times 10^{-4}$ | 15 | 12 | ○ | 0.09 | Δ | X |
| 0.01 | $6.54 \times 10^{-4}$ | 16 | 15 | ○ | 2 | ○ | ○ |
| 0.05 | $3.27 \times 10^{-3}$ | 17 | 18 | ○ | 7 | ○ | ○ |
| 0.1 | $6.54 \times 10^{-3}$ | 18 | 24 | ○ | 11 | ○ | ○ |
| 0.25 | $1.64 \times 10^{-2}$ | 19 | 30 | ○ | 29 | ○ | ○ |
| 0.5 | $3.27 \times 10^{-2}$ | 20 | 32 | ○ | 58 | ○ | ○ |
| 1 | $6.54 \times 10^{-2}$ | 21 | 35 | ○ | 103 | ○ | ○ |
| 2.5 | $1.64 \times 10^{-1}$ | 22 | 35 | ○ | 273 | ○ | ○ |
| 5 | $3.27 \times 10^{-1}$ | 23 | 35 | ○ | 585 | ○ | ○ |
| 10 | $6.54 \times 10^{-1}$ | 24 | 35 | ○ | 986 | ○ | ○ |
| 3 Cr Steel | | | | | | | |
| 0 | 0 | 25 | 2 | X | 0 | X | X |
| 0.001 | $6.54 \times 10^{-5}$ | 26 | 4 | X | 0.03 | X | X |
| 0.005 | $3.27 \times 10^{-4}$ | 27 | 6 | ○ | 0.05 | Δ | X |
| 0.01 | $6.54 \times 10^{-4}$ | 28 | 13 | ○ | 3 | ○ | ○ |
| 0.05 | $3.27 \times 10^{-3}$ | 29 | 15 | ○ | 8 | ○ | ○ |
| 0.1 | $6.54 \times 10^{-3}$ | 30 | 19 | ○ | 9 | ○ | ○ |
| 0.25 | $1.64 \times 10^{-2}$ | 31 | 23 | ○ | 31 | ○ | ○ |
| 0.5 | $3.27 \times 10^{-2}$ | 32 | 26 | ○ | 59 | ○ | ○ |
| 1 | $6.54 \times 10^{-2}$ | 33 | 32 | ○ | 112 | ○ | ○ |
| 2.5 | $1.64 \times 10^{-1}$ | 34 | 35 | ○ | 263 | ○ | ○ |
| 5 | $3.27 \times 10^{-1}$ | 35 | 35 | ○ | 610 | ○ | ○ |
| 10 | $6.54 \times 10^{-1}$ | 36 | 35 | ○ | 907 | ○ | ○ |

[1]Evaluation;

[2]Overall Evaluation

TABLE 3

| Potassium tetraborate | | | Film | | | | |
|---|---|---|---|---|---|---|---|
| | | | Thickness | | Potassium | Film | |
| Mass % | Mole % | Test No. | (μm) | Eval[1] | Content (mg/m$^2$) | Uniformity | O.E.[2] |
| | | | 5 Cr Steel | | | | |
| 0 | 0 | 37 | 2 | X | 0 | X | X |
| 0.001 | $6.54 \times 10^{-5}$ | 38 | 6 | ○ | 0.02 | X | X |
| 0.005 | $3.27 \times 10^{-4}$ | 39 | 11 | ○ | 0.07 | Δ | X |
| 0.01 | $6.54 \times 10^{-4}$ | 40 | 13 | ○ | 3 | ○ | ○ |
| 0.05 | $3.27 \times 10^{-3}$ | 41 | 14 | ○ | 7 | ○ | ○ |
| 0.1 | $6.54 \times 10^{-3}$ | 42 | 19 | ○ | 9 | ○ | ○ |
| 0.25 | $1.64 \times 10^{-2}$ | 43 | 21 | ○ | 26 | ○ | ○ |
| 0.5 | $3.27 \times 10^{-2}$ | 44 | 25 | ○ | 47 | ○ | ○ |
| 1 | $6.54 \times 10^{-2}$ | 45 | 28 | ○ | 90 | ○ | ○ |
| 2.5 | $1.64 \times 10^{-1}$ | 46 | 34 | ○ | 230 | ○ | ○ |
| 5 | $3.27 \times 10^{-1}$ | 47 | 34 | ○ | 568 | ○ | ○ |
| 10 | $6.54 \times 10^{-1}$ | 48 | 35 | ○ | 907 | ○ | ○ |
| | | | 13 Cr Steel | | | | |
| 0 | 0 | 49 | 0 | X | 0 | X | X |
| 0.001 | $6.54 \times 10^{-5}$ | 50 | 3 | X | 0.01 | X | X |
| 0.005 | $3.27 \times 10^{-4}$ | 51 | 8 | ○ | 0.08 | X | X |
| 0.01 | $6.54 \times 10^{-4}$ | 52 | 10 | ○ | 1 | ○ | ○ |
| 0.05 | $3.27 \times 10^{-3}$ | 53 | 12 | ○ | 6 | ○ | ○ |
| 0.1 | $6.54 \times 10^{-3}$ | 54 | 15 | ○ | 8 | ○ | ○ |
| 0.25 | $1.64 \times 10^{-2}$ | 55 | 18 | ○ | 20 | ○ | ○ |
| 0.5 | $3.27 \times 10^{-2}$ | 56 | 18 | ○ | 43 | ○ | ○ |
| 1 | $6.54 \times 10^{-2}$ | 57 | 20 | ○ | 90 | ○ | ○ |
| 2.5 | $1.64 \times 10^{-1}$ | 58 | 23 | ○ | 223 | ○ | ○ |
| 5 | $3.27 \times 10^{-1}$ | 59 | 26 | ○ | 530 | ○ | ○ |
| 10 | $6.54 \times 10^{-1}$ | 60 | 26 | ○ | 897 | ○ | ○ |
| | | | 22 Cr Steel | | | | |
| 0 | 0 | 61 | 0 | X | 0 | X | X |
| 0.001 | $6.54 \times 10^{-5}$ | 62 | 0 | X | 0 | X | X |
| 0.005 | $3.27 \times 10^{-4}$ | 63 | 0 | X | 0 | X | X |
| 0.01 | $6.54 \times 10^{-4}$ | 64 | 0 | X | 0 | X | X |
| 0.05 | $3.27 \times 10^{-3}$ | 65 | 0 | X | 0 | X | X |
| 0.1 | $6.54 \times 10^{-3}$ | 66 | 0 | X | 0 | X | X |
| 0.25 | $1.64 \times 10^{-2}$ | 67 | 1 | X | 0 | X | X |
| 0.5 | $3.27 \times 10^{-2}$ | 68 | 1 | X | 0 | X | X |
| 1 | $6.54 \times 10^{-2}$ | 69 | 1 | X | 0 | X | X |
| 2.5 | $1.64 \times 10^{-1}$ | 70 | 2 | X | 0 | X | X |
| 5 | $3.27 \times 10^{-1}$ | 71 | 2 | X | 0.01 | X | X |
| 10 | $6.54 \times 10^{-1}$ | 72 | 2 | X | 0.01 | X | X |

[1]Evaluation;
[2]Overall Evaluation

In the tables, the film thickness was evaluated as follows: X (unacceptable) indicates a film thickness of less than 5 micrometers and ○ (good) indicates a thickness of at least 5 micrometers. The uniformity of the film was evaluated by the test result of area ratio (%) of unhidden surface (exposed metallic surface) observed in the film formed on the test pieces. ○ (good) indicates an area ratio of at most 5%, Δ (usual) indicates an area ratio of greater than 5% and at most 20%, and X (unacceptable) indicates an area ratio exceeding 20%. For the overall evaluation, ○ (acceptable) indicates that the test results were ○ for both the film thickness and the uniformity of the film, and X (unacceptable) indicates that the test results were Δ or X for one or both of the film thickness and the film uniformity.

Example 3

In this example, an oil well steel pipe which is a seamless steel pipe made from a Cr-containing steel (C: 0.25%) with a Cr content of 1%, 3%, or 13% was used for treatment.

A test piece measuring 5 mm thick, 25 mm wide, and 30 mm long was cut from each of the above-described Cr-containing steel pipes, which had been adjusted so that its outer surface had a surface roughness Rmax of 5 micrometers.

In this example, a chemical conversion treatment liquid was prepared by adding potassium tetraborate to a commercially available zinc phosphate chemical conversion treatment liquid to give a concentration of 0-10%.

FIG. 1 is a schematic illustration showing the setup used in a dripping type test method used employed in this example.

As shown in the FIGURE, a chemical conversion treatment liquid 1 is kept at a temperature of 80° C. in a vessel having a capacity of 500 ml. The chemical conversion treatment liquid 1 was dripped for 5 minutes from a dripping apparatus 3 onto the outer surface side of a test piece 2 which had been subjected to pretreatment such as degreasing and rinsing with water. The test piece 2 was then rinsed with water and dried. The chemical conversion treatment liquid 1 was heated by a hot water for heating 5, and it was recirculated and reused by a pump 4.

The resulting chemical conversion film was evaluated in the same manner as in Example 1. The test results are shown in Table 4.

TABLE 4

| Potassium tetraborate | | | Film | | | | |
|---|---|---|---|---|---|---|---|
| | | | Thickness | | Potassium | Film | |
| Mass % | Mole % | Test No. | (μm) | Eval[1] | Content (mg/m$^2$) | Uniformity | O.E.[2] |
| | | | 1 Cr Steel | | | | |
| 0 | 0 | 1 | 3 | X | 0 | X | X |
| 0.001 | $6.54 \times 10^{-5}$ | 2 | 6 | ○ | 0.07 | Δ | X |
| 0.005 | $3.27 \times 10^{-4}$ | 3 | 11 | ○ | 0.08 | Δ | X |
| 0.01 | $6.54 \times 10^{-4}$ | 4 | 15 | ○ | 2 | ○ | ○ |
| 0.05 | $3.27 \times 10^{-3}$ | 5 | 17 | ○ | 5 | ○ | ○ |
| 0.1 | $6.54 \times 10^{-3}$ | 6 | 22 | ○ | 10 | ○ | ○ |
| 0.25 | $1.64 \times 10^{-2}$ | 7 | 24 | ○ | 26 | ○ | ○ |
| 0.5 | $3.27 \times 10^{-2}$ | 8 | 28 | ○ | 48 | ○ | ○ |
| 1 | $6.54 \times 10^{-2}$ | 9 | 31 | ○ | 90 | ○ | ○ |
| 2.5 | $1.64 \times 10^{-1}$ | 10 | 33 | ○ | 230 | ○ | ○ |
| 5 | $3.27 \times 10^{-1}$ | 11 | 33 | ○ | 580 | ○ | ○ |
| 10 | $6.54 \times 10^{-1}$ | 12 | 35 | ○ | 990 | ○ | ○ |
| | | | 3 Cr Steel | | | | |
| 0 | 0 | 13 | 0 | X | 0 | X | X |
| 0.001 | $6.54 \times 10^{-5}$ | 14 | 2 | X | 0.01 | X | X |
| 0.005 | $3.27 \times 10^{-4}$ | 15 | 6 | ○ | 0.07 | Δ | X |
| 0.01 | $6.54 \times 10^{-4}$ | 16 | 13 | ○ | 2 | ○ | ○ |
| 0.05 | $3.27 \times 10^{-3}$ | 17 | 15 | ○ | 5 | ○ | ○ |
| 0.1 | $6.54 \times 10^{-3}$ | 18 | 18 | ○ | 9 | ○ | ○ |
| 0.25 | $1.64 \times 10^{-2}$ | 19 | 21 | ○ | 23 | ○ | ○ |
| 0.5 | $3.27 \times 10^{-2}$ | 20 | 25 | ○ | 46 | ○ | ○ |
| 1 | $6.54 \times 10^{-2}$ | 21 | 27 | ○ | 90 | ○ | ○ |
| 2.5 | $1.64 \times 10^{-1}$ | 22 | 29 | ○ | 225 | ○ | ○ |
| 5 | $3.27 \times 10^{-1}$ | 23 | 30 | ○ | 578 | ○ | ○ |
| 10 | $6.54 \times 10^{-1}$ | 24 | 35 | ○ | 897 | ○ | ○ |
| | | | 13 Cr Steel | | | | |
| 0 | 0 | 25 | 0 | X | 0 | X | X |
| 0.001 | $6.54 \times 10^{-5}$ | 26 | 0 | X | 0 | X | X |
| 0.005 | $3.27 \times 10^{-4}$ | 27 | 4 | X | 0.06 | X | X |
| 0.01 | $6.54 \times 10^{-4}$ | 28 | 8 | ○ | 1 | ○ | ○ |
| 0.05 | $3.27 \times 10^{-3}$ | 29 | 12 | ○ | 5 | ○ | ○ |
| 0.1 | $6.54 \times 10^{-3}$ | 30 | 13 | ○ | 8 | ○ | ○ |
| 0.25 | $1.64 \times 10^{-2}$ | 31 | 17 | ○ | 20 | ○ | ○ |
| 0.5 | $3.27 \times 10^{-2}$ | 32 | 23 | ○ | 44 | ○ | ○ |
| 1 | $6.54 \times 10^{-2}$ | 33 | 23 | ○ | 86 | ○ | ○ |
| 2.5 | $1.64 \times 10^{-1}$ | 34 | 26 | ○ | 172 | ○ | ○ |
| 5 | $3.27 \times 10^{-1}$ | 35 | 33 | ○ | 498 | ○ | ○ |
| 10 | $6.54 \times 10^{-1}$ | 36 | 35 | ○ | 836 | ○ | ○ |

[1]Evaluation;
[2]Overall Evaluation

In the tables, the film thickness was evaluated as follows: X (unacceptable) indicates a film thickness of less than 5 micrometers and ○ (good) indicates a thickness of at least 5 micrometers. The uniformity of the film was evaluated by the test result of area ratio (%) of unhidden surface (exposed metallic surface) observed in the film formed on the steel pipe test pieces. ○ (good) indicates an area ratio of at most 5%, Δ (usual) indicates an area ratio of greater than 5% and at most 20%, and X (unacceptable) indicates an area ratio exceeding 20%. For the overall evaluation, ○ (acceptable) indicates that the test results were ○ for both the film thickness and the uniformity of the film, and X (unacceptable) indicates that the test results were Δ or X for one or both of the film thickness and the film uniformity.

Example 4

In this example, an oil well steel pipe made from a Cr-containing steel (C: 0.25%) having a Cr content of 1%, 3%, or 13% was prepared.

Test pieces were cut from the above-described steel pipe which had been adjusted so that its outer surface had a surface roughness Rmax of 5 micrometers. Each test piece was 5 mm thick, 25 mm wide, and 30 mm long.

A chemical conversion treatment liquid was prepared by adding potassium tetraborate to a commercially available manganese phosphate chemical conversion treatment liquid to give a concentration of 0.1-1.0% and then adjusting the total acid number to at least 30 and less than 55 and the ratio of the total acid number to the free acid number to 8.2-9.0. The chemical conversion treatment liquid was placed at a temperature of 95° C. in a 1000 ml container. Test pieces on which pretreatment such as degreasing and rinsing with water had been performed were immersed for twenty minutes in the chemical conversion treatment liquid and then were washed with water and dried.

The chemical conversion film formed on the surface of the steel of the test pieces was evaluated in the same manner as in Example 1.

In the table, film uniformity was evaluated by the area ratio of unhidden surface (exposed metallic surface) as follows: ◎ (excellent) indicates an area ratio of at most 1%, ○ (good) indicates an area ratio of greater than 1% and at most 5%. For the overall evaluation, ○ (acceptable) indicates that the test results were ◎ or ○ for the uniformity of the film. The test results are shown in Table 5.

TABLE 5

| Postassium tetraborate | | Total | Free | | Film | | | | |
|---|---|---|---|---|---|---|---|---|---|
| Mass % | Mole % | Acid Number | Acid Number | Acid Ratio | Thickness (μm) | Evaluation | Potassium content (mg/m$^2$) | Film uniformity | Overall evaluation |
| | | | | 1 Cr Steel | | | | | |
| 0.1 | $6.54 \times 10^{-3}$ | 30.1 | 3.6 | 8.4 | 22 | ○ | 11 | ○ | ○ |
| | | 35.5 | 4.2 | 8.5 | 22 | ○ | 11 | ○ | ○ |
| | | 42.3 | 5.0 | 8.5 | 23 | ○ | 12 | ◎ | ○ |
| | | 47.2 | 5.4 | 8.7 | 23 | ○ | 12 | ◎ | ○ |
| | | 48.9 | 5.8 | 8.4 | 23 | ○ | 13 | ◎ | ○ |
| | | 53.0 | 6.0 | 8.8 | 23 | ○ | 13 | ◎ | ○ |
| 1 | $6.54 \times 10^{-2}$ | 30.2 | 3.7 | 8.2 | 35 | ○ | 120 | ○ | ○ |
| | | 35.8 | 4.3 | 8.3 | 35 | ○ | 135 | ◎ | ○ |
| | | 41.1 | 4.8 | 8.6 | 34 | ○ | 140 | ◎ | ○ |
| | | 47.8 | 5.5 | 8.7 | 35 | ○ | 162 | ◎ | ○ |
| | | 51.6 | 6.0 | 8.6 | 35 | ○ | 180 | ◎ | ○ |
| | | 53.0 | 5.9 | 9.0 | 38 | ○ | 200 | ◎ | ○ |
| | | | | 3 Cr Steel | | | | | |
| 0.1 | $6.54 \times 10^{-3}$ | 30.1 | 3.6 | 8.4 | 15 | ○ | 10 | ○ | ○ |
| | | 35.5 | 4.2 | 8.5 | 15 | ○ | 11 | ○ | ○ |
| | | 42.3 | 5.0 | 8.5 | 18 | ○ | 10 | ◎ | ○ |
| | | 47.2 | 5.4 | 8.7 | 19 | ○ | 11 | ◎ | ○ |
| | | 48.9 | 5.8 | 8.4 | 20 | ○ | 12 | ◎ | ○ |
| | | 53.0 | 6.0 | 8.8 | 20 | ○ | 12 | ◎ | ○ |
| 1 | $6.54 \times 10^{-2}$ | 30.2 | 3.7 | 8.2 | 32 | ○ | 102 | ○ | ○ |
| | | 35.8 | 4.3 | 8.3 | 32 | ○ | 108 | ◎ | ○ |
| | | 41.1 | 4.8 | 8.6 | 33 | ○ | 126 | ◎ | ○ |
| | | 47.8 | 5.5 | 8.7 | 33 | ○ | 140 | ◎ | ○ |
| | | 51.6 | 6.0 | 8.6 | 32 | ○ | 148 | ◎ | ○ |
| | | 53.0 | 5.9 | 9.0 | 33 | ○ | 162 | ◎ | ○ |
| | | | | 13 Cr Steel | | | | | |
| 0.1 | $6.54 \times 10^{-3}$ | 30.1 | 3.6 | 8.4 | 15 | ○ | 6 | ○ | ○ |
| | | 35.5 | 4.2 | 8.5 | 16 | ○ | 8 | ○ | ○ |
| | | 42.3 | 5.0 | 8.5 | 16 | ○ | 9 | ○ | ○ |
| | | 47.2 | 5.4 | 8.7 | 16 | ○ | 9 | ○ | ○ |
| | | 48.9 | 5.8 | 8.4 | 16 | ○ | 10 | ◎ | ○ |
| | | 53.0 | 6.0 | 8.8 | 17 | ○ | 10 | ◎ | ○ |
| 1 | $6.54 \times 10^{-2}$ | 30.2 | 3.7 | 8.2 | 20 | ○ | 90 | ○ | ○ |
| | | 35.8 | 4.3 | 8.3 | 20 | ○ | 91 | ○ | ○ |
| | | 41.1 | 4.8 | 8.6 | 20 | ○ | 90 | ○ | ○ |
| | | 47.8 | 5.5 | 8.7 | 21 | ○ | 93 | ◎ | ○ |
| | | 51.6 | 6.0 | 8.6 | 20 | ○ | 93 | ◎ | ○ |
| | | 53.0 | 5.9 | 9.0 | 21 | ○ | 96 | ◎ | ○ |

INDUSTRIAL APPLICABILITY

According to the present invention, using a chemical conversion treatment liquid containing zinc and phosphoric acid or manganese and phosphoric acid to which 0.01-10% of a potassium compound is added, it is possible to easily and stably form a sound phosphate chemical conversion film which is uniform and has excellent adhesion to the surface of a steel containing 0.5-13% Cr. Furthermore, using the present invention, it is possible to easily and stably form a thick chemical conversion film having adhesion superior to that of the prior art on a carbon steel as well.

The invention claimed is:

1. A method of manufacturing a surface treated oil well pipe comprising performing chemical conversion treatment on an oil well pipe having a steel composition containing 0.5-13% Cr using a chemical conversion treatment liquid containing zinc and phosphoric acid or manganese and phosphoric acid and further containing potassium tetraborate to form a chemical conversion film of a zinc-phosphate type or a manganese phosphate type, wherein the chemical conversion treatment is carried out in the absence of fluoride ions and further wherein a total acid number of the chemical conversion treatment liquid is at least 30 and less than 55, a free acid number is 3.6 to 6.0, and a ratio of the total acid number to the free acid number is 6 to 11.

2. A method of manufacturing a surface treated oil well pipe as claimed in claim 1 wherein the chemical conversion treatment liquid has a molar concentration of potassium-containing ions of at least $6\times10^{-4}$% and at most $7\times10^{-1}$%.

3. A method of manufacturing a surface treated oil well pipe as claimed in claim 1 wherein chemical conversion treatment is carried out by immersing the surface of the oil well pipe in the chemical conversion treatment liquid at a temperature of 60-100° C. for at least five minutes.

4. A method of manufacturing a surface treated oil well pipe as claimed in claim 1 wherein the chemical conversion treatment is carried out by supplying the chemical conversion treatment to the surface of the oil well pipe at a temperature of 60-100° C. for at least five minutes.

5. The method of claim 1, wherein rinsing treatment with water and drying treatment is followed after the chemical conversion treatment.

6. The method of claim 1, wherein the chemical conversion film is formed on the steel surface of the oil well pipe when a product of chemical reaction between a solution and the surface of the oil well pipe adheres to the steel surface in the chemical conversion treatment.

* * * * *

UNITED STATES PATENT AND TRADEMARK OFFICE

CERTIFICATE OF CORRECTION

PATENT NO. : 7,918,945 B2
APPLICATION NO. : 10/771294
DATED : April 5, 2011
INVENTOR(S) : Izawa et al.

It is certified that error appears in the above-identified patent and that said Letters Patent is hereby corrected as shown below:

Title page, item [62]

Related U.S. Application Data should read:

Division of application No. 10/277,964, filed on Oct. 23, 2002, now Pat. No. 6,756,092, which is a Continuation of PCT/JP02/01521, filed on Feb. 21, 2002.

Signed and Sealed this
First Day of November, 2011

David J. Kappos

David J. Kappos
*Director of the United States Patent and Trademark Office*